US005338343A

United States Patent [19]

Kroll et al.

[11] Patent Number: 5,338,343

[45] Date of Patent: Aug. 16, 1994

[54] CATALYTIC ELECTROLESS GOLD PLATING BATHS

[75] Inventors: Harry H. Kroll, E. Greenwich; Jean Chevalier, Cranston, both of R.I.

[73] Assignee: Technic Incorporated, Cranston, R.I.

[21] Appl. No.: 96,558

[22] Filed: Jul. 23, 1993

[51] Int. Cl.[5] ..... C23C 18/44

[52] U.S. Cl. ..... 106/1.23; 106/1.26

[58] Field of Search ..... 106/1.23, 1.26

[56] References Cited

U.S. PATENT DOCUMENTS

| | | | |
|---|---|---|---|
| 3,700,469 | 10/1972 | Okinaka | 106/1.23 |
| 3,917,885 | 11/1975 | Baker | 427/304 |
| 3,977,884 | 8/1976 | Gulla et al. | 106/1.26 |
| 4,337,091 | 6/1982 | El-shazly et al. | 106/1.23 |
| 4,838,937 | 6/1989 | Ott | 106/1.23 |
| 4,919,720 | 4/1990 | Stavitsky | 106/1.26 |
| 4,985,076 | 1/1991 | Iacovangelo | 106/1.26 |
| 4,999,054 | 3/1991 | Perovetz et al. | 106/1.23 |
| 5,035,744 | 7/1991 | Nishiyama et al. | 106/1.23 |

FOREIGN PATENT DOCUMENTS

| | | | |
|---|---|---|---|
| 0343816 | 11/1989 | European Pat. Off. | C23C 18/44 |
| 3938653A1 | 11/1989 | Fed. Rep. of Germany | C23C 18/44 |

OTHER PUBLICATIONS

Electroless Plating, edited by G. O. Mallory & J. B. Hajdu, Chap. 15: Electroless Plating of Gold and Gold Alloys by Y. Ikinaka, pp. 401–419–Published by American Electroplaters & Surface Finishers Society, 1990 no month.

H. O. Ali and I. R. Christie Gold Bulletin, 17,(4) 118 (1984) no month.

M. Matsuoka, S. Imanishi, M. Sahara & T. Hayashi, Plating and Surface, Finishing , p. 102, May, 1988.

F. Simon, Gold Bulletin 26(1) 14–23 (1993) no month.

Y. Okinaka and C. Wolowodiuk, Plating, 58, 1080–1084 (1971) no month.

R. J. Puddephat, "The Chemistry of Gold", p. 61, Elsevier Scientific Pub. 1979 no month.

*Primary Examiner*—Helene Klemanski

*Attorney, Agent, or Firm*—Ernest V. Linek

[57] ABSTRACT

An electroless catalytic gold plating solution is disclosed comprising a water soluble organic thiol gold (I) complex, an alkali metal cyanide, an alkali metal hydroxide, a borohydride reducing agent, and may also contain a stabilizing agent. The electroless gold plating solution will deposit gold on a gold surface several times faster than the conventional electroless gold baths based on potassium aurous cyanide. The use of an organic thiol gold (I) complex eliminates the buildup of inhibitory cyanide ions as a result of replenishment.

12 Claims, No Drawings

CATALYTIC ELECTROLESS GOLD PLATING BATHS

BACKGROUND OF THE INVENTION

The deposition of gold on selected surfaces of electronic circuitry by chemical or electroless processes has been actively investigated for several decades. There are many reviews that thoroughly describe these efforts. (Electroless Plating, Y. Okinaka, p. 401–419 (1990); H. O. Ali and I. R. A. Christie, Gold Bull., 17 (4), 118 (1984)). There are three mechanisms by which a water-soluble gold salt can be deposited on a metallic substrate. They are:

(1) A displacement process where aurous (or auric) gold is reduced to metallic gold and the substrate metal, usually nickel, is oxidized to the plus two valence state as a water soluble complex.

(2) A catalytic displacement process where a metal, such as palladium, is deposited on the metal substrate and the palladium promotes the reduction of aurous gold to metallic gold and the oxidation of the substrate metal to a metal ion., (3) A catalytic chemical process whereby a water-soluble gold complex is reduced by a reducing agent present in the composition and metallic gold is deposited on a gold surface which acts as a catalyst for the chemical deposition.

The disclosures of the invention are concerned specifically with a catalytic electroless gold deposition process as defined in (3) above. Electroless gold baths of this type were first patented by Okinaka (U.S. Pat. No. 3,700,469 (1972)). These baths contain potassium aurous cyanide as the source of gold, potassium or sodium cyanide as a stabilizer, and an alkali metal borohydride or dimethylamine borane as the reducing agent. Alkali metal hydroxides such as potassium hydroxide provide the alkalinity for the borohydrides to function effectively as reducing agents. The borohydride baths, when handled carefully, gives useful results. However, they have several serious shortcomings. Traces of nickel ions and or organic impurities result in bath decomposition. The initial plating rate in practice, is slow, about 1 micron/hour. As the bath continues to be used, the cyanide ion concentration increases slowing down the deposition rate. Another shortcoming of the Okinaka bath is the formation of small gold granules in the plating solution. Extended use of the bath by replenishment decreases its stability and slows down the deposition rate. For practical applications, a gold deposition rate of two to five microns per hour is required. Trace amounts of lead ions or thallous ions will enhance gold plating rates. (M. Matsuoka, S. Imanishi, M. Sahara, and T. Hayashi, Plating and Surface Finishing, p. 102 (1988)). Although 1–2 mg/liter of thallous ion significantly increases the gold deposition rate, it has a negative effect on the overall stability of the plating bath. The use of trace amounts of lead in this bath requires careful monitoring because of the incorporation of this ion in the deposit and the adverse affect it might have on its functional properties.

Another process is described by F. Simon, Gold Bull., 26(1) pp. 14–23 (1993), wherein an electroless bath utilizes potassium aurous cyanide. At pages 21–22 of this reference, the author describes the inhibitory effect of accumulating cyanide ion on the rate of gold deposition and a vague reference to the addition of an accelerator to overcome this slowdown.

The stabilization of electroless gold baths based on borohydride/amineborane reducing agents, potassium aurous cyanide, alkali metal cyanides, and alkali metal hydroxides has been a major problem in the use of this chemistry. Trace amounts of transition metal ions, organic impurities, and localized over heating are among the contributors leading to the spontaneous decomposition of the bath.

The catalytic electroless gold bath of this invention is a quasi-stable solution which maintains its integrity as long as certain electrochemical and chemical conditions are met. The gold source utilized in the bath of the present invention does not contain cyanide and therefore gold deposition and replenishment cannot increase the cyanide concentration above the amount needed to stabilize the bath. The catalytic nature of the gold substrate permits the adsorption of preferred intermediates formed by the interactions of the chemical agents that make up the solution which in turn lead to the deposition of metallic gold on the substrate. If this sensitive process is interfered with by impurities, unfavorable electrochemical conditions, or excessive temperatures, bath decomposition will result, frequently instantaneously.

To protect these baths against trace metals, the use of chelating agents have been proposed. Where the decomposition is due to nickel ions, these chemicals at best slow down the decomposition but do not prevent it. European Patent Application No. 0 343 816 discloses a potassium borohydride/potassium aurous cyanide bath containing potassium ferrocyanide and potassium ferricyanide which can plate gold directly on nickel without decomposition. Monoethyl ethers of ethyleneglycol and diethylene glycol have been disclosed as stabilizers, (DE Patent No. 3707817 AI)as well as ethyleneglycol, (U.S. Pat. No. 4,919,720).

The accumulation of cyanide ions in the bath due to the plating process slows down the rate of gold deposition. (Y. Okinaka and C. Wolowodiuk, Plating, 58, 1080 (1971)). These investigators disclosed the use of aurous cyanide as a gold replenishment to partially offset the inhibitory effect of increasing cyanide concentration on the deposition rate. An alternative method to avoid the accumulation of ionic cyanide is given in U.S. Pat. No. 3,917,885 where an aqueous solution of an alkali metal gold succinimide complex is used instead of potassium aurous cyanide. Potassium cyanide is included as a stabilizer. No details are given for the preparation of the gold succinimide complex but it is probable that the gold is in a trivalent state because compounds of this type are prepared from potassium tetrachloroaurate. A related approach is disclosed in U.S. Pat. No. 4,337,091 where potassium aurate (or auric hydroxide)is used as the gold source.

One of the products resulting from the alkali metal borohydrides and dimethylamine borane is potassium metaborate. The accumulation of this chemical in the bath causes the precipitation of gold particles and is responsible for a loss of the gold plating component. It is a common practice in gold electroplating to dissolve gold deposits by the use of a water soluble aromatic nitro compound and an alkali metal cyanide. This chemistry is used in DE Patent No. 3938653 AI to prevent the formation of gold particles in their electroless plating bath.

SUMMARY OF THE INVENTION

The novel feature of this invention is the use of water soluble gold (I) thiolates as the source of metal. An unexpected result from the use of these compounds is that the gold deposition rate is several times greater than those attained by the use of potassium aurous cyanide and the several other gold compounds disclosed in the prior art. The gold (I) thiolates have the general formula:

$$(AuSR)_n \text{ where } n=1\text{-}8$$

There are two methods for the synthesis of these compounds and they are summarized by R. J. Puddephatt "The Chemistry of Gold", p. 61. The following mercaptans have been converted to water soluble salts of the gold (I) thiolates and have been used in the electroless gold baths of this invention:

1. 3-mercapto-1-propanesulfonate, sodium salt ($R=-CH_2CH_2CH_2SO_3Na$)
2. 2-mercaptoethane sulfonate, sodium salt ($R=-CH_2CH_2SO_3Na$)
3. 3-mercapto 2-hydroxy-1-propanesulfonate, sodium salt ($R=-CH_2CH(OH)CH_2SO_3Na$)
4. mercaptosuccinic acid (or thiomalic acid, $R=-CH(COOH)CH_2COOH$)
5. mercaptoacetic acid ($R=-CH_2COOH$)
6. 2-mercaptopropionic acid ($R=H_3C-(CH)-CH_2-COOH$)
7. thiosalicylic acid ($R=-CH_6H_4COOH$)
8. L-cysteine ($R=-CH(NH_2)COOH$)

Another aspect of this invention is that an excess of the mercaptan may be incorporated into the formulation with beneficial results in the plating process, The formula for the gold (I) thiolate shown above is intended to indicate that it may be cyclic in nature and made up of alternate gold and sulfur bonds. In the presence of an excess of mercaptan, the cyclic compound breaks down into monomeric complexes:

$$(AuSR)_n + nHSR \rightarrow nH(RSAuSR)$$

That monomeric gold (I) dithiolates produced by the above reaction leads to improved plating rates is supported by the observation that gold deposition increases when excess mercaptan is added to the bath. The metallic gold contents of these baths (introduced as gold (I) thiolates) is between 0.5 to 3.0 g/liter and is provided by about 0.001 to 0.05 molar of a water soluble gold (i) thiolate.

There are experimental data which indicate that cyanide ions may participate in the following equilibrium:

$$nKCN + (AuSR)_n \rightleftarrows nK(RSAuCN)$$

The amount of cyanide in the bath is critical, and is provided by about 0.01 to 0.1 molar of a water soluble cyanide salt. Potassium cyanide in the concentration range of 0.020M to 0.20M are preferred. Concentrations of cyanide below these values result in bath instability whereas higher levels slow down the gold deposition rate. Since the gold (I) thiolate does not contain cyanide, the gold deposition and replenishment take place at a constant and optimum cyanide ion concentration.

The preferred reducing agents used in this invention are the alkali metal borohydrides. Either sodium or potassium borohydride can be used but the potassium derivative is preferred because of somewhat better solubility characteristics. The concentration of the reducing agent used in these baths are from 0.01 molar to 0.4 molar, preferably, 0.1 molar to 0.4 molar. Dimethylamine borane can also be used as a reducing agent but in order to attain the same deposition rates as the alkali metal borohydrides the baths must be operated at temperatures ten to twenty degrees higher. The alkali metal hydroxide requirement is also greater. The higher operating temperature of the dimethylamine borane baths is a serious disadvantage because of the frequent necessity of replacing water evaporation losses.

The pH of the electroless gold baths of this invention is between 12 to 14. This alkalinity is attained by the use of alkali metal hydroxides, preferably potassium hydroxide and is provided by about 0.1 to 1.0 molar of an alkali metal hydroxide, such as potassium hydroxide. For the alkali metal borohydrides, potassium hydroxide concentration varies between 5 g/liter to 20 g/liter. For the dimethylamine borane baths, the potassium hydroxide concentration can vary between 10 g/liter to 40 g/liter. The hydroxide ion concentration contributes two important bath characteristics: (1) it slows down the hydrolytic loss of the borohydride or the borane and (2) it reacts with the reducing agent to form the active intermediate for the catalytic reduction of the gold (I) thiolate to metallic gold.

The working temperature for the alkali metal borohydride bath is 70°-80° C. whereas the dimethylamine borane bath functions best at 85°100° C.

DETAILED DESCRIPTION OF THE PREFERRED EMBODIMENTS

A characteristic of catalytic electroless gold baths operating maximally for a period of time or after one or more replenishments is the appearance of gold particulates in the solution. Although these can be removed by continuous filtration the presence of this non-functional metallic gold in the system is undesirable. The particles act as a loci for useless gold deposition and possibly to decomposition of the bath itself. Alkali metal cyanides are one of the stabilizers of this invention. The cyanide ion in conjunction with selected water soluble aromatic nitro compounds is capable of converting gold particulates as they form initially in the plating solution to soluble aurous cyanide complexes which are utilized in the gold plating process. The aromatic nitro oxidizing agents, introduced at about 0.0001 to 0.01 molar of a water soluble aromatic nitro compound, contribute to the stability of the bath and the efficiency of the plating process. Compounds which have been found to be useful for this application are sodium 3nitrobenzoate, sodium 3-nitrobenzene sulfonate, and sodium 4-chloro, 3nitrobenzoate. The concentration of the gold solubilizing agents used in these baths range from 0.025 mg/liter to 50 mg/liter.

The property of most interest in an electroless gold plating bath is its deposition rate expressed in millionths of an inch per hour or microns per hour. Unfortunately the methods used to obtain these values as described in the patent and technical literature are often lacking in detail so that it is difficult to compare different sets of data. The following procedures were used to obtain the data disclosed in this invention: Copper foil, 25 microns thick, was cut into 1.5×3.0 cm. strips, and a ¼ in. hole punched near the top of the strip. The test pieces were cleaned, etched, and then coated with a low phosphorous electroless nickel, 2–4% P, to a thickness of 4–5 microns of bright nickel. The test pieces were then treated in an immersion gold bath to deposit a thickness of 0.1 to 0.2 microns of gold. Four test pieces were mounted on a teflon disc and held in place by teflon screws. The disc was then attached to a teflon rod which permitted the rigidly mounted samples to be immersed in the catalytic electroless gold bath. The electroless gold plating solution was placed in a jacketed one liter beaker whose inlet and outlet were connected to a constant temperature water bath equipped with a water pump to maintain a constant flow and temperature in the water jacket of the beaker. The electroless gold solution was agitated via a magnetic stirrer and a 1.5 inch magnetic stirring bar rotated at a constant speed. The temperature of the bath was 70° C.±1° C. The test was carried out for one hour after which the test pieces were removed and the gold thickness measured by X-ray fluorescence. The four samples yielded measurements which were averaged to yield the plating rate in millionths of an inch per hour and converted to microns/hr.

PREPARATION OF GOLD (I) THIOLATES

EXAMPLE 1

Au (I) 3-mercaptopropane I-sulfonate, sodium salt. Potassium auric chloride, 20.2 g, 0.05 moles, was dissolved in 200 ml of water and then filtered to yield a clear yellow solution. 3-mercaptopropane-I-sulfonate, sodium salt, 33.4 g, 0.165 moles, was dissolved in 450 ml of water and cooled to 10° C. in an ice bath. The potassium auric chloride solution was added dropwise to mercaptopropane sulfonate. Good agitation was applied during this phase of the reaction. When the addition was complete, the agitation was continued for an additional thirty minutes. The final product was a water white solution containing 0.0148 grams of soluble monovalent gold per milliliter of solution. This product could be used directly in the electroless gold formulation.

All of the gold (I) thiolates of this invention were prepared by the above procedure with some modifications. Au(I) mercapto acetic acid was isolated as the free acid and had a gold content of 21%. All of the gold (I) thiolates prepared by the above procedure contained the dithio derivative formed by the oxidation of the starting mercaptan in the reduction of the trivalent gold to the monovalent state.

The electroless gold deposition rates of the gold (I) thiolates of this invention and the compositions of their respective plating baths using potassium borohydride as the reducing agent are given in Table 1. Table 2 shows a similar set of data where the reducing agent is dimethylamine borane.

TABLE 1

Rate of Gold Deposition: Au(I)Thiolates/$KBH_4$ Systems

| Au Compound | Au g/L | KOH g/L | KCN g/L | $KBH_4$ g/L | MNB mg/L | Temp °C. | Time min. | Microns/hr. |
|---|---|---|---|---|---|---|---|---|
| $KAu(CN)_2$ (control) | 1.3 | 13 | 6.2 | 13.2 | 36 | 70 | 60 | 0.75 |
| 3-MPS | 1.3 | 13 | 6.2 | 13.2 | 36 | 70 | 60 | 2.6 |
| 2-MES | 1.3 | 13 | 6.2 | 13.2 | 36 | 70 | 60 | 4.6 |
| TMA | 1.3 | 13 | 6.2 | 13.2 | 36 | 70 | 60 | 3.3 |
| MAA | 1.3 | 13 | 6.2 | 13.2 | 36 | 70 | 60 | 3.3 |
| MPA | 1.3 | 13 | 6.2 | 13.2 | 36 | 70 | 60 | 0.75 |
| TSA | 1.3 | 13 | 6.2 | 13.2 | 36 | 70 | 60 | 3.5 |
| L-Cys | 1.3 | 13 | 6.2 | 13.2 | 36 | 70 | 60 | 4.0 |

3-MPS 3-mercaptopropane-l-sulfonate, sodium salt
2-MES 2-mercaptoethanesulfonate, sodium salt
TMA thiomalic acid
MAA mercaptoacetic acid
MPA 2-mercaptopropionic acid
TSA thiosalicylic acid
MNB meta-nitrobenzoic acid
L-Cys L-cysteine

TABLE 2

Rate of Gold Deposition: Au(I)Thiolates/Dimethylamine Borane

| Au Compound | Au g/L | KOH g/L | KCN g/L | DMB g/L | MNB mg/L | Temp °C. | Time min. | Microns/hr. |
|---|---|---|---|---|---|---|---|---|
| $KAu(CN)_2$ (control) | 1.3 | 43 | 7 | 9.2 | 30 | 90 | 60 | 0.55 |
| 3-MPS | 1.3 | 43 | 7 | 9.2 | 30 | 90 | 60 | 4.4 |
| 2-MES | 1.3 | 43 | 7 | 9.2 | 30 | 90 | 60 | 4.5 |
| MAA | 1.3 | 43 | 7 | 9.2 | 30 | 90 | 60 | 2.2 |

The present invention has been described with the specific compositions contained therein and the processes for carrying out the chemical deposition of gold on a gold substrates. It will be understood that numerous modifications may be made by those skilled in the art without departing from the scope of the invention as defined in the appended claims.

What is claimed is:

1. An electroless gold plating composition capable of depositing gold on a gold substrate comprising about 0.001 to 0.05 molar of a water soluble gold (I) thiolate, about 0.01 to 0.1 molar of a water soluble cyanide salt, about 0.1 to 1.0 molar of an alkali metal hydroxide, about 0.0001 to 0.01 molar of a water soluble aromatic nitro compound, and about 0.01 to 0.4 molar of a reducing agent selected from the group consisting of the alkali metal borohydrides and dimethylamine borane, the resulting composition having a pH range from 12 to 14.

2. An electroless gold plating composition of claim 1, where the gold (I) thiolate is gold (I) 3-mercaptopropane-1-sulfonate, sodium salt.

3. An electroless gold plating composition of claim 1, where the gold (I) thiolate is gold (I) 2-mercaptoethane-1-sulfonate, sodium salt.

4. An electroless gold plating composition of claim 1, where the gold (I) thiolate is gold (I) thiomalic acid.

5. An electroless gold plating composition of claim 1, where the gold (I) thiolate is gold (I) mercaptoacetic acid.

6. An electroless gold plating composition of claim 1, where the gold (I) thiolate is gold (I) thiosalicylic acid.

7. An electroless gold plating composition of claim 1, where the gold (I) thiolate is gold (I) L-cysteine.

8. An electroless gold plating solution of claim 1, where the water soluble cyanide salt is potassium cyanide.

9. An electroless gold plating solution of claim 1, where the alkali metal hydroxide is potassium hydroxide.

10. An electroless gold plating solution of claim 1, where the water soluble aromatic nitro compound may be either sodium 3-nitrobenzoate or sodium 4-chloro, 3-nitrobenzoate, or sodium 3-nitrobenzene sulfonate.

11. An electroless gold plating composition of claim 1, where the reducing agent is sodium or potassium borohydride.

12. An electroless gold plating solution of claim 1, where the reducing agent is dimethylamine borane.

* * * * *